US011540370B2

(12) United States Patent
Herrera et al.

(10) Patent No.: US 11,540,370 B2
(45) Date of Patent: Dec. 27, 2022

(54) METHODS AND APPARATUSES FOR CONTROLLING A PULSED-OUTPUT CONSTANT VOLTAGE LED DRIVER

(71) Applicant: Hatch Transformers, Inc., Tampa, FL (US)

(72) Inventors: Howard Herrera, Tampa, FL (US); Soufiane Daoudiya, Tampa, FL (US)

(73) Assignee: Hatch Transformers, Inc., Tampa, FL (US)

( * ) Notice: Subject to any disclaimer, the term of this patent is extended or adjusted under 35 U.S.C. 154(b) by 0 days.

(21) Appl. No.: 17/474,247

(22) Filed: Sep. 14, 2021

(65) Prior Publication Data

US 2021/0410247 A1 Dec. 30, 2021

Related U.S. Application Data

(63) Continuation-in-part of application No. PCT/US2020/049607, filed on Sep. 6, 2020.

(60) Provisional application No. 62/898,406, filed on Sep. 10, 2019.

(51) Int. Cl.
*H05B 45/325* (2020.01)
*H05B 45/20* (2020.01)
*H05B 45/10* (2020.01)

(52) U.S. Cl.
CPC ..... *H05B 45/325* (2020.01); *H05B 45/10* (2020.01); *H05B 45/20* (2020.01)

(58) Field of Classification Search
None
See application file for complete search history.

(56) References Cited

U.S. PATENT DOCUMENTS 5,942,902 A * 8/1999 Okayasu ..... G01R 29/0273 324/617
6,586,890 B2 7/2003 Min et al.
6,643,158 B2 11/2003 McDonald et al.
7,038,399 B2 5/2006 Lys et al.
8,638,045 B2 1/2014 Kunst et al.
11,083,067 B2 8/2021 Greenwood et al.
(Continued)

FOREIGN PATENT DOCUMENTS

WO WO-2009040705 A2 * 4/2009 ..... H05B 33/0803

*Primary Examiner* — Crystal L Hammond
(74) *Attorney, Agent, or Firm* — V Gerald Grafe

(57) ABSTRACT

Embodiments of the invention provide a pulsed-output constant voltage LED driver comprising a PDM stage configured to provide power to an LED load by supplying energy at either a first or second predetermined voltage during each of a plurality of segments of a predetermined time period, wherein the number of segments during which the first voltage is supplied is correlated with the power provided to the LED, and wherein the positions within the time period of the segments during which the first voltage is applied are random. Embodiments of the invention provide a method of supplying power to an LED load using a pulsed-output constant voltage LED driver, the method comprising: varying a number of pulses provided by the pulsed-output constant voltage LED driver over a fixed period of time such that the number of pulses determines the power level provided to the LED load, wherein varying the number of pulses allows for modulation in a light output of the LED load, and wherein the temporal position of the pulses in the fixed period of time is random.

20 Claims, 12 Drawing Sheets

(56) References Cited

U.S. PATENT DOCUMENTS

| | | | | |
|---|---|---|---|---|
| 2011/0050467 | A1* | 3/2011 | Crespi | H03F 3/217 341/55 |
| 2011/0204805 | A1 | 8/2011 | Li et al. | |
| 2012/0200229 | A1* | 8/2012 | Kunst | H05B 45/385 315/186 |
| 2017/0251539 | A1* | 8/2017 | Cho | H05B 47/22 |

* cited by examiner

METHODS AND APPARATUSES FOR CONTROLLING A PULSED-OUTPUT CONSTANT VOLTAGE LED DRIVER

FIELD OF THE INVENTION

This invention generally relates to lighting systems and the power systems therefor.

BACKGROUND OF THE INVENTION

A conventional method that is used for dimming light-emitting diodes (LEDs) powered by a constant voltage LED driver involves varying the amplitude of the LED driver output voltage. A shortcoming of this method is that changing the output voltage of the LED driver when dimming changes the level of current flowing through the LED, and thus changes its correlated color temperature (CCT) level. Furthermore, this method of varying the amplitude of the driver output voltage does not provide for a consistent dimming range as it will be determined entirely by the characteristics of the constant-voltage LED load.

Additionally, at or near the low end of the dimming range, the load, which can include a plurality of LEDs, can end up with some of its LEDs brighter than the others. This occurs because the LED driver output voltage has fallen below the working forward voltage of the load. This forward voltage is divided between the plurality of LEDs that make up the load. As a result the forward voltage applied across each LED can result in a visually detectable lumen variation between the LEDs in the load, up to the point of some LEDs failing to be illuminated at all.

Embodiments of the invention described herein provide methods and apparatuses for dimming LEDs powered by a pulsed-output constant voltage LED driver that addresses the problems described above. These and other advantages of the invention, as well as additional inventive features, will be apparent from the description of the invention provided herein.

Numerous methods for programming the un-dimmed output voltage of power supplies and LED drivers have been developed and described in patents and literature. However, most inventions use either a removeable cartridge for altering a parameter in the control loop of the power supply in question or use a serial programming method, whether wireless or connected, to program the output voltage. Further, these methods control a fixed, constant DC output voltage level.

For these methods it typically requires additional system components in the form of a programming station or device and must be re-programmed using said programming system. Other embodiments become limited to only programming the output voltage since they are modifying the control loop. Altering parameters in the control loop can also contribute to control loop instability.

Embodiments of the invention described herein provide methods and apparatus for programming the voltage amplitude of the output pulses of a pulsed-output constant voltage LED driver, as well as other parameters that address the shortcomings described above.

BRIEF SUMMARY OF THE INVENTION

Various references are cited in the present specification to facilitate understanding of the present invention. Each of those references is incorporated herein by reference.

It is known in the art that dimming an LED array simply by reducing the voltage amplitude can be accompanied by anomalous lighting system behavior such as LED color changes and discontinuous illumination in multi-LED configurations. Further, it is known in the art that keeping the forward voltage constant and instead supplying pulses of fixed duration whose duration is proportional to a dimming signal is a method for reducing said anomalous behavior during dimming. Noteworthy of said method is prior art described in U.S. Pat. No. 6,586,890, Min, et. al. wherein an LED driver circuit with pulse width modulation (PWM) is described for use in automobiles and other vehicles to differentiate between full light and a dim mode. Similarly, in U.S. Pat. No. 7,038,399 Lys et al. describe a method of providing power to LED lighting devices using PWM. A method of controlling the color temperature of an LED light source is described in U.S. Pat. No. 8,638,045, Kunst, et al. whereby pulse density modulation (PDM) is disclosed. Kunst teaches the use of pulse width modulation in the form of a burst of pulses followed by a quiet period, in combination with a complementary duty cycle, thereby effectively controlling the color temperature of dual LED strings with non-identical colors in a ratio-metric fashion. However, Kunst does not teach random positional assignment of the pulses on a frame-by-frame basis, or methods thereof.

Embodiments of the present invention provide a pulsed-output constant voltage LED driver that utilizes a randomized PDM dimming method, proportional to one or more of a plurality of input signals, whose quantity of fixed amplitude output pulses is proportional to one or more of a plurality of input signals and whose pulse positions are randomized based on a mathematical algorithm that varies the position, but not the quantity, of said pulses on a frame-by-frame basis. Embodiments of the present invention provide said randomized pulse positions in a manner such that a minimum individual pulse width will be maintained. Embodiments of the present invention provide a pulsed-output constant voltage LED driver whose pulsed output voltage is programmed by one of any number of methods including digital command or physical removeable cartridge that is permanently affixed to the LED driver. Embodiments of the present invention provide a method of configuring the output pulse amplitude of a pulsed-output constant voltage LED driver to overcome line loss in remote mounting applications.

Example embodiments of the invention include a pulsed-output constant voltage LED driver that includes, among other elements to become apparent, an output stage connected to a processor. The control of the average power delivered to the LED load is proportional to one or more dimming control signals and allows for proportional dimming of the LED load. During operation, the processor constructs a signal 'frame' that is further comprised of possible individual pulse positions or locations. The processor executes an algorithm that randomly assigns position placement within the context of a frame. Further, the PDM stage does not have pre-set output pulses or their associated locations, rather, specific embodiments assign a set of fixed duty cycle pulses at random positions within the frame using a randomization algorithm to determine the assigned position for each of the fixed-width output pulses.

In some example embodiments, the pulsed-output constant voltage LED driver further includes an electrical interface. The electrical interface supports one or more input signals which are translated into a PDM modulated constant-voltage output proportional to the level provided in the input signal. This proportionality can be linear or follow logarithmic or exponential curves that correspond to how human eyes perceive differences in light levels.

In some example embodiments, the one or more input signals is one of a 0-10V analog input, a PWM input, a capacitive touch input, a phase cut input, a potentiometer input, and a command from a wired or wireless communications port. The one or more input signals can be used to control the modulation level of a PDM-modulated constant-voltage output.

In some example embodiments, the one or more input signals can be used to determine the voltage amplitude of the output pulses, turning the driver effectively into a programmable pulsed output constant-voltage driver capable of being used with loads of different input voltage levels (e.g. 12 VDC, 24 VDC, 36 VDC, 48 VDC, etc.). This input signal can be applied when the pulsed-output constant voltage LED driver is either powered or unpowered. In an example embodiment this input signal can take the form of a removeable cartridge that is permanently inserted into the pulsed-output constant voltage LED driver to program the output pulse voltage amplitude.

One or more low-level communication interfaces (UART, SPI, I2C) and/or discrete signals (binary or analog) can be used to allow one or more higher-level control systems to interact with the LED driver either directly or via intermediate communication modules based on wired (DALI, DMX, etc.) or wireless (ZigBee, Bluetooth, Wi-Fi, LoRa, SigFox, Cellular, etc.) technologies.

The pulsed-output constant voltage LED driver can include a plurality of PDM stages where each PDM stage is connected to its respective LED load. The control mechanisms for the pulsed-output constant voltage LED driver having multiple PDM stages can be similar or identical to those used for a driver with a single PDM stage. Similarly, the communication interfaces supported by the multiple-PDM-stage driver can be the same as those for single-PDM-stage drivers.

In an example embodiment of the invention, the plurality of PDM stages is configured to achieve either white color tuning by varying the light intensity of LEDs with different CCT levels, or RGB color tuning by mixing light from red, green, and blue LEDs.

Example embodiments of the invention provide a method of supplying power to an LED load using a pulsed-output constant voltage LED driver with a randomized series of fixed amplitude output pulses. The method includes the step of varying the number of fixed amplitude pulses provided by the pulsed-output constant voltage LED driver over a fixed period of time such that the number of pulses determines the power delivered to the LED load, wherein varying the number of pulses allows for modulation in a light output of the LED load.

In some example embodiments, the method also includes controlling the amplitude of the fixed voltage output pulse of the pulsed-output constant voltage LED driver via an input signal and can further include providing an interface control configured to provide one or more input signals. An example method can call for providing an interface control configured to provide one or more input signals such as a 0-10V analog input, a PWM input, a capacitive touch input, a phase cut input, a potentiometer input, and a command from a wired or wireless communications port.

In some example embodiments, the method includes providing one or more low-level communication interfaces (UART, SPI, I2C) and/or discrete signals (binary or analog) that allow a plurality of higher-level control systems to interact with the pulsed-output constant voltage LED Driver either directly or via intermediate communication modules based on wired (DALI, DMX, etc.) or wireless (ZigBee, Bluetooth, Wi-Fi, LoRa, SigFox, cellular, etc.) technologies.

The method can also include varying a CCT level of the LED load to achieve white color tuning, or alternatively, mixing light from red, green, and blue LEDs to achieve RGB color tuning.

Certain characteristics of a lighting luminaire can be controlled by using a plug-in cartridge that changes the analog values of certain passive components in the circuitry of the LED power supply used in said luminaire. Greenwood, in U.S. Pat. No. 11,083,067 teaches that changing the resistance value in the feedback circuit of a constant current LED driver can be used to change the root-mean-square (rms) output current of the driver using a removeable plug-in cartridge that includes passive elements that are part of the control loop. Similarly, McDonald, in U.S. Pat. No. 6,643,158 teaches the use of analog values in a removeable cartridge of a power supply circuit to change the DC output voltage of a power supply used in a charging system. The drawbacks to said removeable cartridges have been previously explained.

In an example embodiment of the invention a removeable plug-in cartridge is provided that programs the characteristics of a luminaire and therefore does not rely on either external programming tools or passive devices interfacing to the control electronics. Rather, a pulsed-output constant voltage LED driver is programmed using a pre-configured digital removeable cartridge that is polled by the driver on power-up. The removeable cartridge itself includes a shift register that is configured during the assembly process through the inclusion or exclusion of passive components, thereby setting a bit value in a register on the removeable cartridge when power is applied to the removeable cartridge by the driver. Information programmed into the removeable cartridge is used to set the voltage amplitude of the randomized pulses.

A further embodiment describes using a non-volatile memory device on the removeable cartridge to store parameters. The non-volatile device, such as a serial EEPROM, is programmed during manufacturing and is polled by the pulsed-output constant voltage LED driver on power-up.

The apparatus and method for using a digital removeable cartridge provides a much broader array of feature programmability in the driver including not only setting the output pulse voltage amplitude but also dimming characteristics such as linear vs logarithmic dimming curves for example. A digital removeable cartridge also provides manufacturing opportunities such as calibration of the actual output dimming levels to known control signal levels.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. The intent is to cover all alternatives, modifications and equivalents as included within the spirit and scope of the invention as defined by the appended claims.

DETAILED DESCRIPTION OF THE INVENTION

Example embodiments of the present invention relate to a method for dimming LED lights being powered by a pulsed-output constant voltage LED driver output. More specifically, example embodiments of the invention address the problems of conventional LED drivers, as described above, by modulating the pulsed-output constant voltage LED driver output using a randomized pulse density modulation (PDM) signal such that the output becomes a disparate set of pulses of constant duration. The quantity of said pulses within each frame is controlled by a dimming effect and whose positional assignment within the frame is defined by a mathematically randomized approach. The dimming effect is realized by varying the density of said pulses proportional to a dimming input signal.

Figure 1:
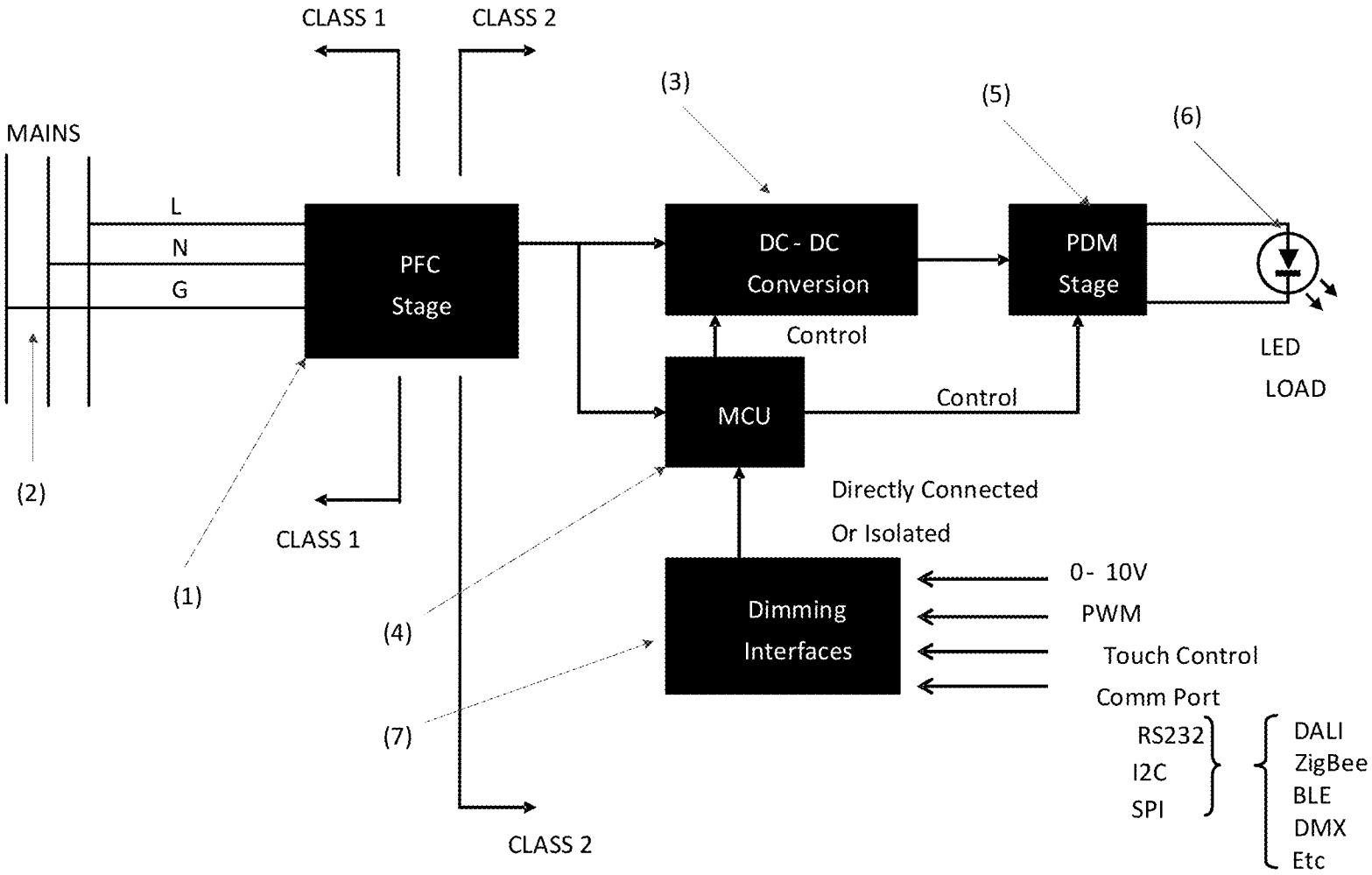
FIG. 1 is a block diagram illustrating a pulsed-output constant voltage LED driver with a single PDM stage in accordance with an embodiment of the invention.

FIG. 1 relates to a single-channel implementation of the pulsed-output constant voltage LED driver (e.g., a single PDM stage with its LED load connected). The system of FIG. 1 includes a power factor correction stage (1) that receives grid power (2) and whose DC output connects to a DC-to-DC converter (3) and to a processor/MCU (4) which controls the DC-to-DC converter and the PDM stage (5) thus controlling operation of the LED load (6). A dimming interface (7) is coupled to the processor. In the figure, CLASS 1 refers to the mains side of the circuit. CLASS 2 refers to the secondary, low voltage which is also galvanically isolated from the Class 1 side of the circuit.

Figure 2:
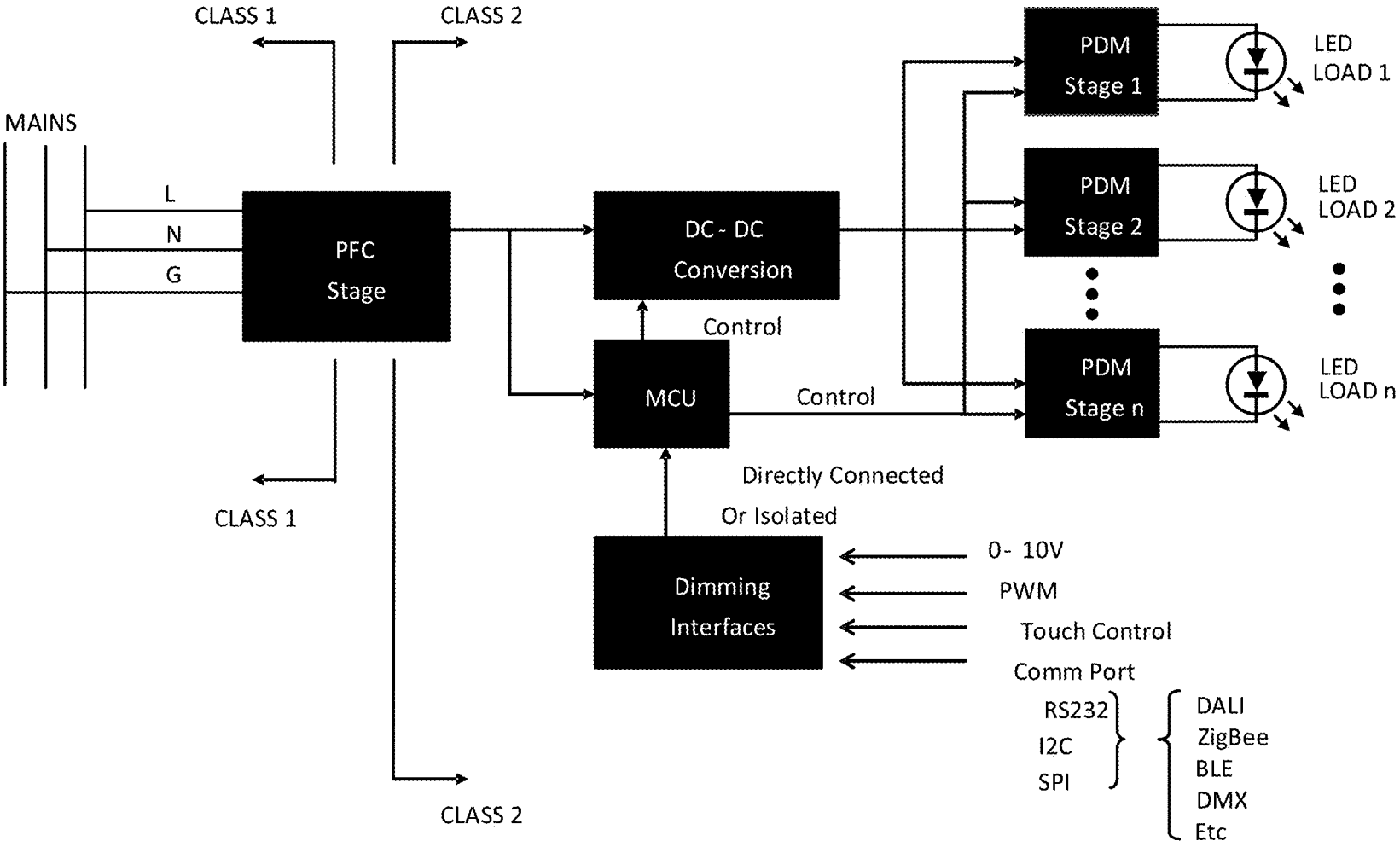
FIG. 2 is a block diagram illustrating a pulsed-output constant voltage LED driver with multiple PDM stages in accordance with an embodiment of the invention.

FIG. 2 shows an implementation of the pulsed-output constant voltage LED driver with multiple PDM stages each connected to its own LED load. There can be "n" number of said stages in a single pulsed-output constant voltage LED driver. An example implementation includes one or more tunable white drivers (requiring anywhere from two to five channels depending on the size and complexity of the implementation). Another example implementation provides for red-green-blue (RGB) color mixing, which generally requires a minimum of three channels. However, additional channels can be added, for example, for white LEDs which render better quality white light than is possible by mixing RGB light. Another example implementation accounts for independent channels meant to drive LED loads independently without any regard for color mixing of any sort.

Note that the embodiments shown in FIGS. 1 and 2 each include dimming interfaces that will ultimately drive the PDM stages to determine the actual dimming level of the LEDs, or dimming level plus CCT Level in the case of Tunable White applications, or dimming level plus Color in the case of RGB color mixing applications.

Turning to the details of the PDM stage, one aspect of this invention is the implementation of random assignment of the pulse positions within a period or 'frame' as a means to accomplish dimming of the LED load and to control the color temperature of the LED load. Through this method, a quantity of fixed pulses is established for a given period of time. Unlike PWM encoding, PDM encoding does not involve changing the duty cycle of a square wave signal. The encoding occurs by outputting the proper quantity of pulses, within a period or frame, the quantity of which are directly proportional to the dimming level as determined by one of the input signals, and directly proportional to the level of the analog signal desired at the output. Further, positional assignment of the pulses in the frame is done via a mathematical relationship that results in non-recurring, pseudo-randomly assigned pulse positions within each frame.

Figure 3:
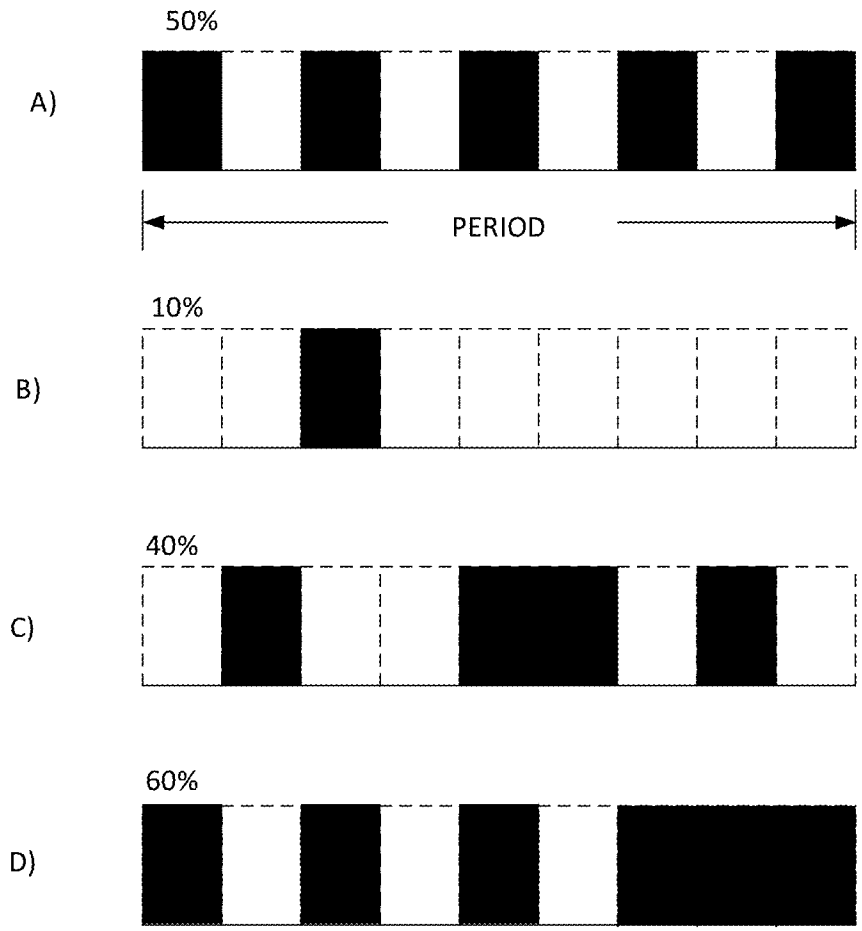
FIG. 3 is a diagram showing examples of a single period of a PDM signal.

To further describe the invention FIG. 3 shows a single full period of four different levels of a PDM output signal. This example considers the full period to be able to contain 10 pulses (shown in dashed lines) thus the signal is at full power when all 10 pulses are present. Consequentially, FIG. 3A includes 5 of the 10 pulse positions as present, resulting in 50% light output. Similarly, FIG. 3D represents 60% light output, and as a result has 6 of the 10 pulse positions occupied. Other implementations can use a much higher number of pulses per period allowing for finer resolution and wider range of dimming (e.g., from 0.1% to 100% of light output in 0.1% level increments). For example, an implementation can incorporate up to 1000 pulses per period, hence, outputting 1 pulse per period would equate to 0.1% of total light output, 10 pulses would equate to 1%, 100 to 10%, 500 to 50% and 1000 to 100% of total light output.

Figure 4:
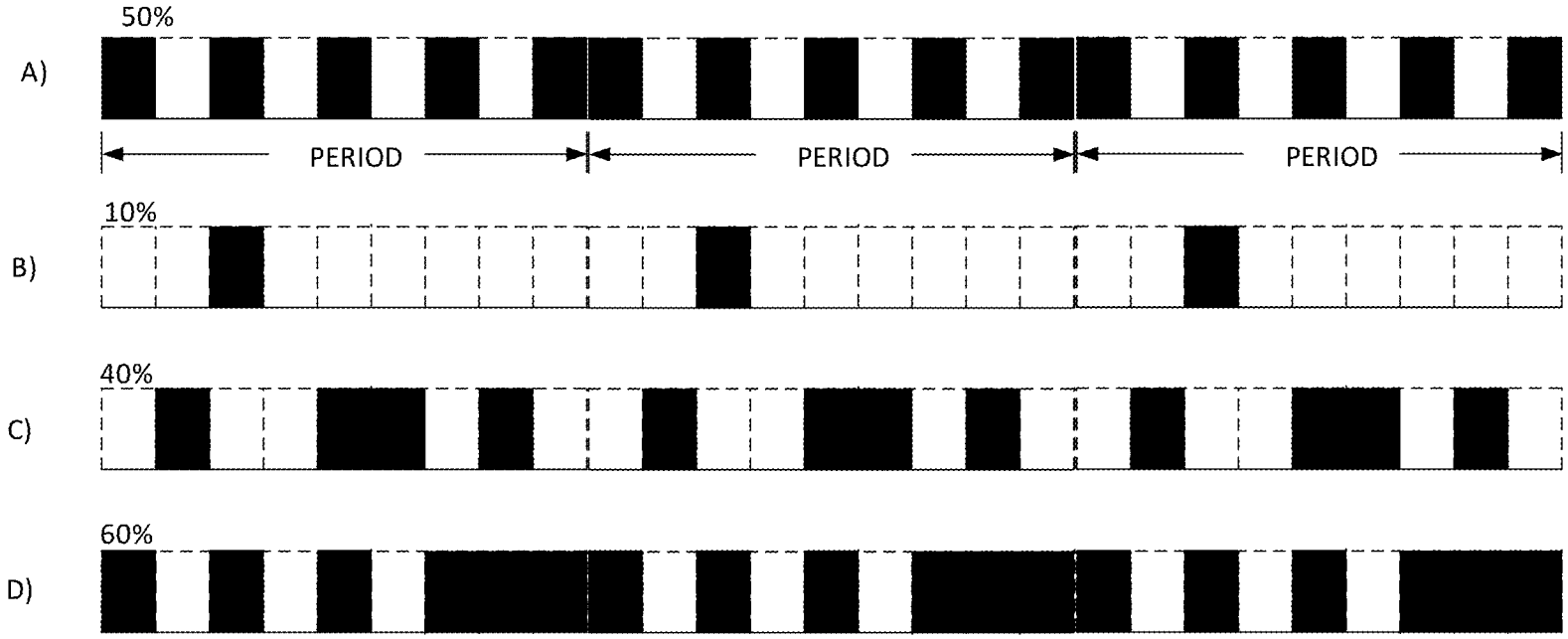
FIG. 4 is a diagram showing examples of consecutive periods of a PDM signal.

FIG. 4 shows several consecutive periods of the signals shown in FIG. 3. FIG. 4 illustrates a recurring PDM signal whereby the individual pulses occupy the same frame position for every frame at that specific dimming level. While in some cases (Signal A and B) the signal might appear to behave as a PWM signal, these are in fact fixed-duration pulses in a recurring PDM approach. Illustrative of this are Signals C and D where the PDM signals are very dissimilar to a PWM signal.

Figure 5:
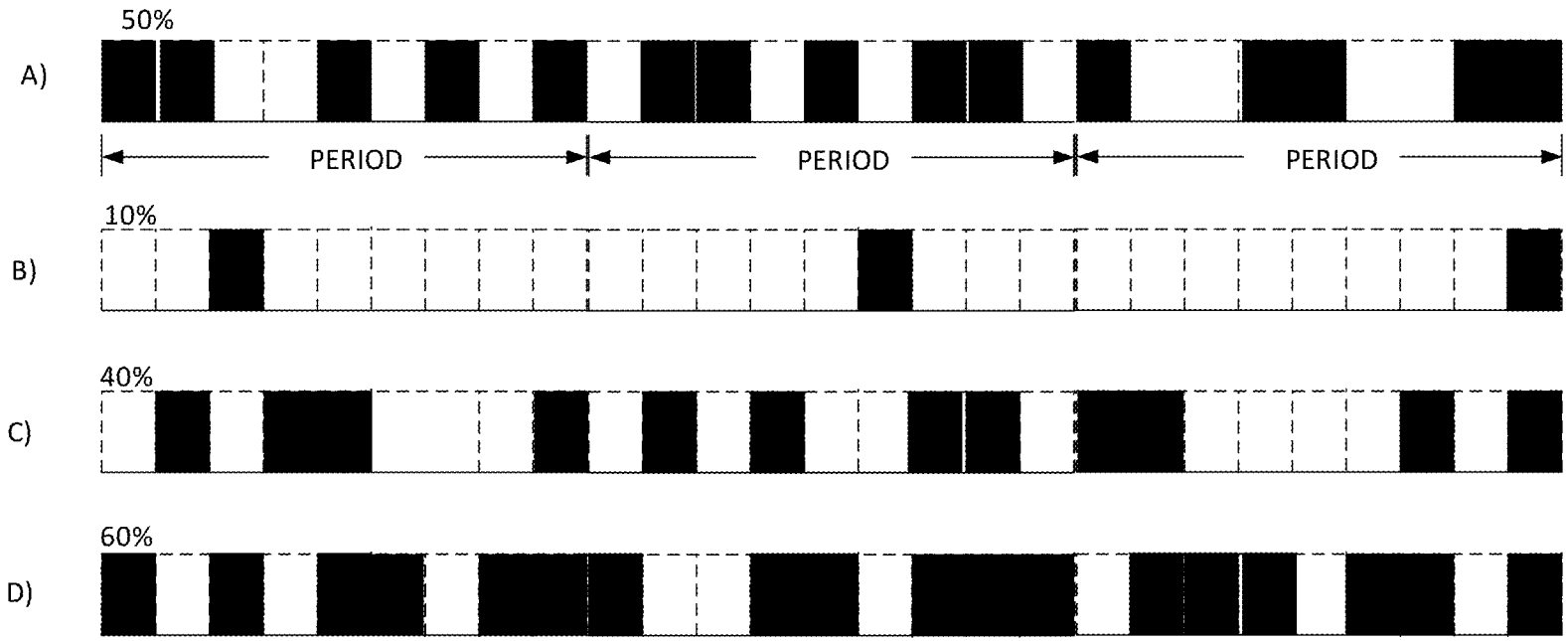
FIG. 5 shows an example of a randomized pulse position within consecutive frames of a PDM signal.

Turning to FIG. 5 which illustrates the sequential random frame configuration, in Signal A it can be seen that at a level of 50% dimming, there are 5 pulses in each frame. However, the individual positions of the pulses within each frame are different. Likewise, this can be seen in Signals B through D. This is characteristically distinct from that taught previously in the art for LED drivers and is an aspect of the invention of frame-by-frame randomized PDM dimming in a pulsed-output constant voltage LED driver. Further, a mathematical algorithm executed by the processor is used to randomize the pulse position on a frame-by-frame basis.

Referring to the aspect of the invention that involves the generation of the random positional assignment of individual pulses, many solutions for generating random numbers exist that can be implemented in microcode.

Figure 6:
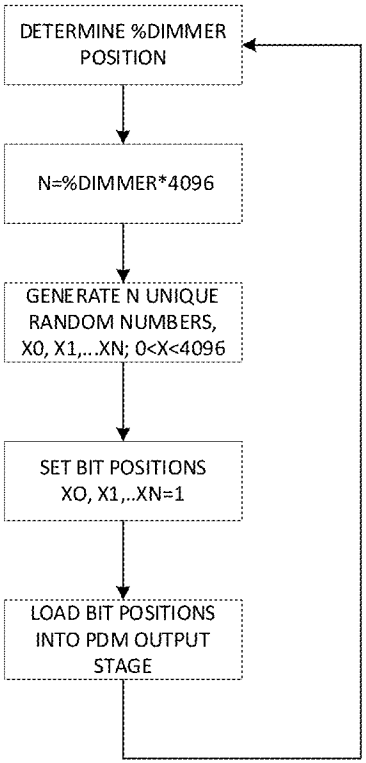
FIG. 6 is a flow diagram showing an example of the logic of generating the random positional assignment of the individual pulses according to a mathematical algorithm.

In one embodiment of the invention, an example frame consists of 4096 bit positions available. FIG. 6 explains the use of an arbitrary mathematical algorithm. The system first measures the dimmer position, such that the % dimming is known. Based on the % dimming desired, a pseudo-random number mathematical algorithm generates the calculated number of random numbers, between 0 and 4096. The random numbers correspond to the bit positions, or high states, to be loaded to the PDM output stage registers. Once the PDM output stage is loaded, the dimmer position is then re-assessed and the next frame of random numbers is generated.

To further illustrate the embodiment, assume that a frame is defined as 4096 pulse positions. Assume also that % dimmer is determined to be 60%. Therefore, 2,457 bit positions must be filled. By running the random number generator algorithm, 2,457 random positional assignments are generated and loaded to the PDM output stage. The sequence is then repeated and assuming the % dimmer value has not changed, another unique set of 2,457 positional assignments are generated and loaded.

A specific embodiment of the algorithm uses a linear congruential generator. The standard linear congruential generator is of the form $$X_{n+1}=(\alpha X_n+c)\bmod m, n>0 \quad (1)$$

Choosing $$\bmod m=2^{12} \quad (2)$$

results in 4096 possible unique values for $X_{n+1}$. For this embodiment, as shown in FIG. 6, the % dimmer position would be determined and 2,457 unique random numbers would be generated according to the algorithm above. It should be recognized by those skilled in the art that $X_{n+1}$ is dependent on $X_n$. As a result, when the algorithm is initialized, a non-zero seed value is required. This can be accomplished using a counter that is re-initialed to a non-zero starting value whenever a new dimmer position is determined.

It should be apparent to those skilled in the art that the example linear congruential mathematical algorithm as described above can be used for generating N random pulse positions to be loaded into the PDM output stage, but also that there are numerous alterations to this random number generator algorithm example. Further, alternate random number generation schemes are possible, such as random number generation based on a Gaussian distribution or a Fibonacci sequence. Thus, the invention is intended to include alternate random number generation algorithms when describing randomized frame-by-frame pulse density modulation in a pulsed-output constant voltage LED driver.

The propagation of higher frequency pulses in extended cable runs can be distorted or attenuated due to the cable inductance. The level of distortion or attenuation is proportional to the frequency of the signal being propagated. The lower the signal frequency, the less amount of attenuation occurs. This is generally governed by the impedance formula $$Z=R+2\pi fL \quad (3)$$

where L is the series self-inductance. It is obvious that R, series resistance, does not change with frequency but that the impedance produced by the series self-inductance value L increases with increasing frequency.

In certain lighting applications, the LED driver can be mounted remotely, thereby being separated from the LED load. This results in series inductance as shown in equation (3). Under certain dimming conditions and for higher pulse count frame definitions, narrow individual pulses can result in undesirable signal attenuation, thereby delivering inaccurate signal levels to the LED load with respect to the desired dimming level.

Figure 12:
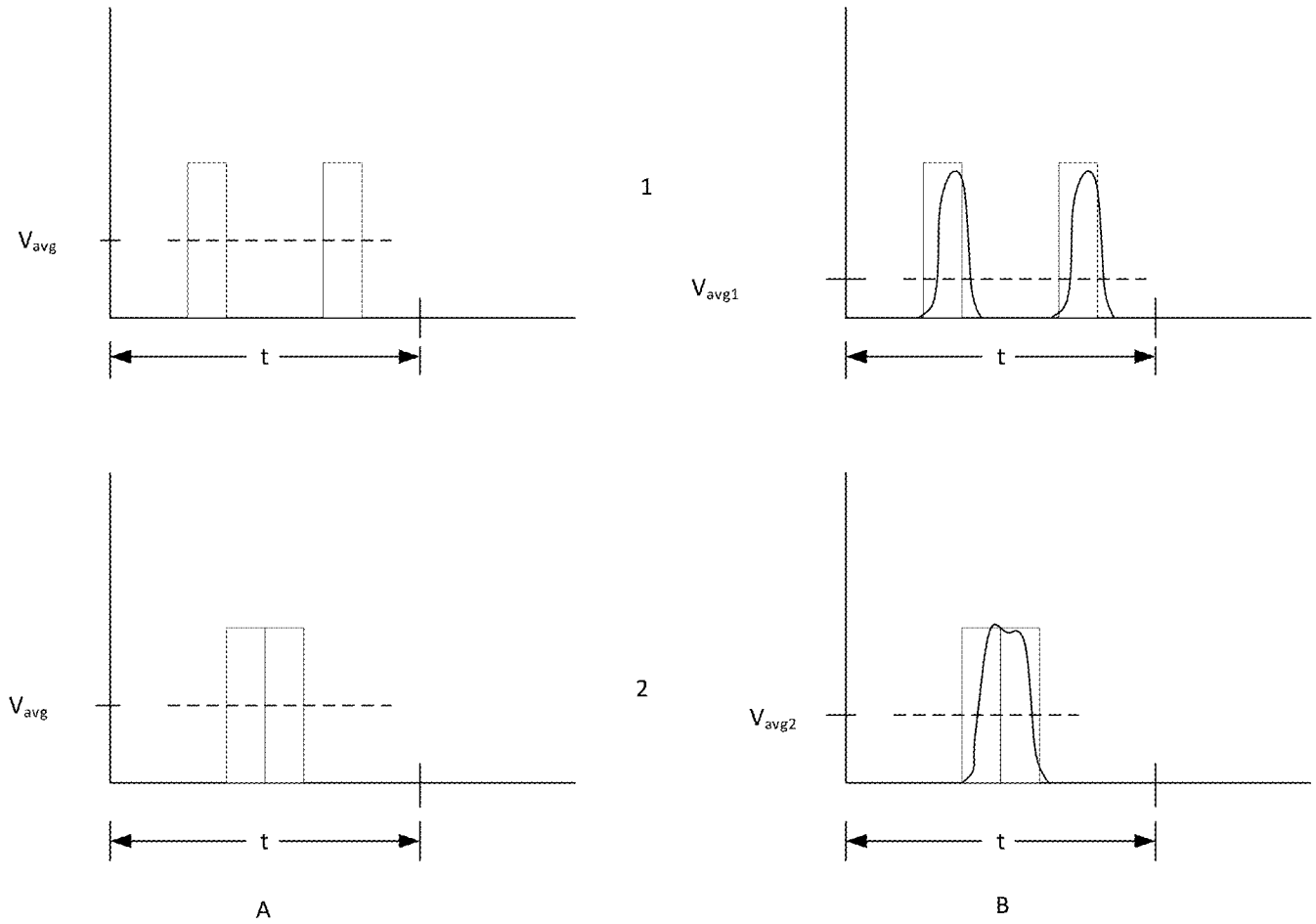
FIG. 12 is an illustration of the effect on average voltage delivered to a load with and without pulse partnering.

FIG. 12 is a further illustration of the effect of high frequency pulses when used in combination with extended cable runs to a LED load. Panel A represents the ideal output pulse at the LED driver for an arbitrary time period t, periodic. In panel 1A, two individual output pulses at a 50% duty cycle result in a $v_{avg}$ over period t. Likewise, in panel 2A, pulses of the same pulse width, but now in adjacent frame positions, result in the same $V_{avg}$ over period t.

Panel B in FIG. 12 illustrates the effect of an arbitrary length of cable in a remote mounting application on the $V_{avg}$ delivered to the load. Panel 1B in FIG. 12 illustrates the effect that the series inductance has on the average voltage delivered to the load. The average voltage delivered to the load is shown as $V_{AVG1}$. Likewise, panel 2B of FIG. 12 illustrates a scenario whereby pulse partnering is used, thus reducing the effective frequency and resulting in a voltage delivered to the load of $V_{AVG2}$, due to effectively reducing the pulse frequency, $V_{AVG2}>V_{AVG1}$.

The effect of pulse partnering as described above can be demonstrated mathematically. For example, assume that bit width of 5 microseconds is used, resulting in an operating frequency of 200 kHz. Assume also that the wire gage for the remote mounting application is AWG24, which has a conductor diameter of 0.0201 inches. For this conductor, the inductance is 0.28 microhenries/foot. Based on equation (3), for a pulse frequency of 200 kHz this results in an impedance of 0.35 ohms/ft. For a 10 foot remote mounting application this results in a total impedance of 7 ohms for a pure sine wave of 200 kHz. This can be seen by the load as a 7 ohm series impedance. Because of the Fourier nature of square waves, higher frequency harmonics are part of the pulse. These higher frequency harmonics experience an even higher impedance. However, due to pulse partnering, the effective pulse width is doubled and the frequency is subsequently reduced by a factor of two. This is then effectively a 3.5 ohm series impedance. As a result, line loss is reduced by pulse partnering.

Figure 7:
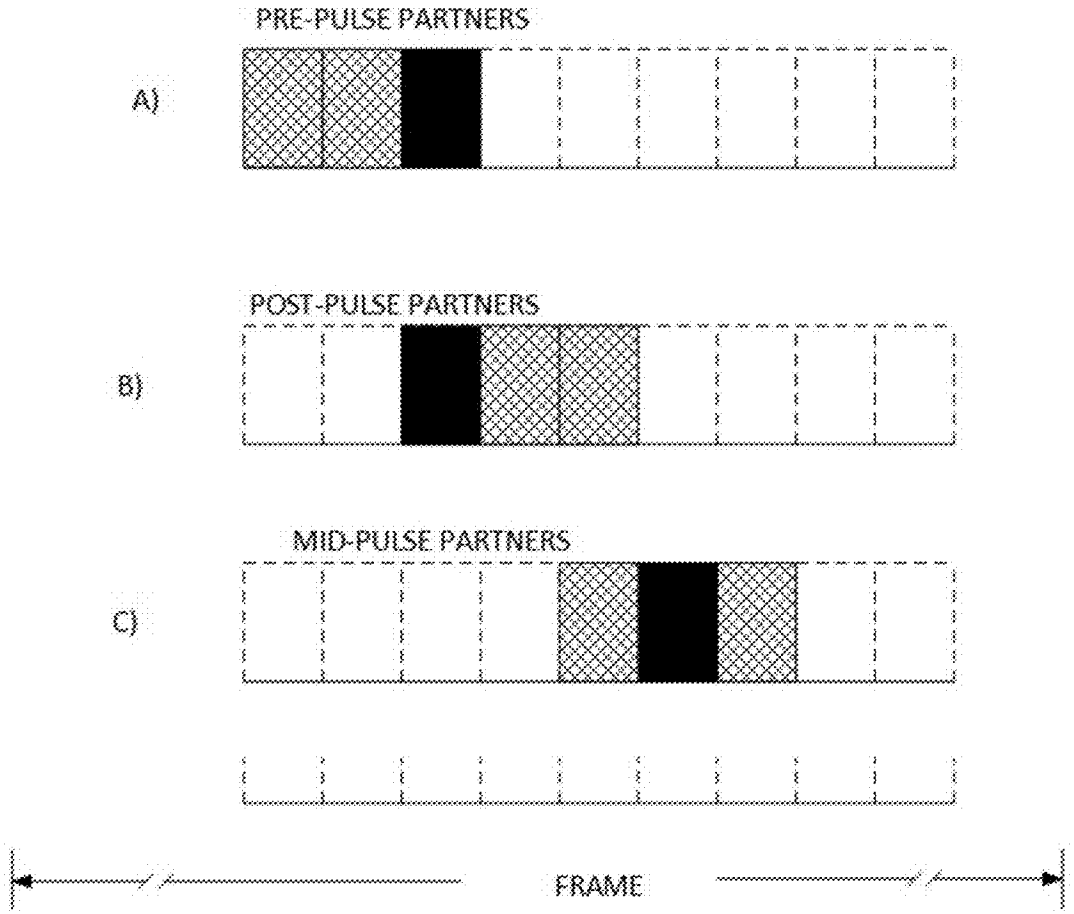
FIG. 7 is a diagram illustrating pulse partnering.

In a further embodiment of the randomized pulse density modulation technique in a pulsed-output constant voltage LED driver as described above, a pulse partnering scheme is described. In FIG. 7 three basic methods of pulse partnering are described. In FIG. 7 part A two additional pulse partners are populated preceding the calculated random pulse position, such that the effective single pulse width has been tripled. This results in an effective frequency reduction, thereby reducing the attenuation. Similarly, FIG. 7 parts B and C illustrate alternative pulse partnering, including assigning post-partner and mid-partner positions, respectively. Algorithmically, it should be obvious to those skilled in the art and of understanding of the previous embodiments that these pulse positions decrement to the total number of pulses required, proportional to the control signal input, prior to loading into the output PDM stage. The number of partner pulses can be varied and optimized based on the pulse frequency and the remote mounting distance between the pulsed-output constant voltage LED driver and the LED load.

Figure 8:
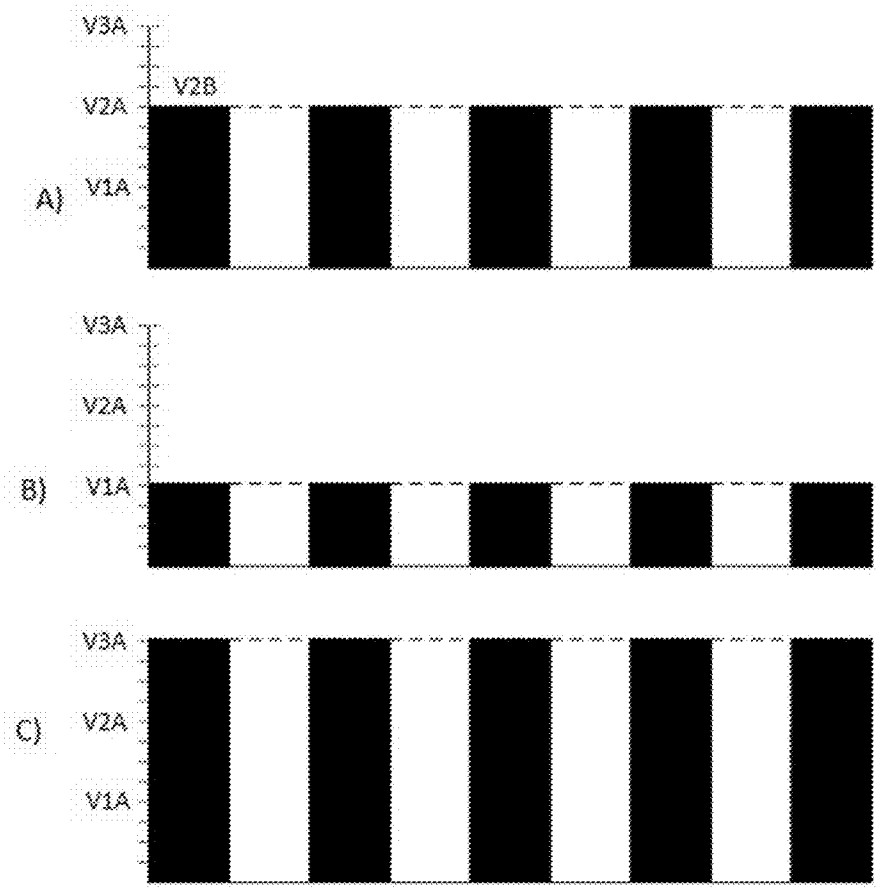
FIG. 8 is a diagram illustrating the pulse amplitude schema.

A further embodiment uses a removeable cartridge that is inserted into the driver to set the voltage amplitude of the output pulse of the pulsed-output constant voltage LED driver. In U.S. Pat. No. 9,324,231B2, Kim, et al, disclose a removable communication module for use in a LED driver. However, the embodiment described by Kim is limited to a communications module. FIG. 8 illustrates pulse output voltage levels V1A, V2A AND V3A. Depending on the needs of the LED load and the complete system, the removeable cartridge is configured to set the randomized PDM pulse amplitude. Let V1A=12V, V2A=24V and V3A=36V. If the LED load is limited to approximately 12 VDC, a pre-configured cartridge can be used that sets the output pulse peak voltage to 12V. Likewise, for an LED load that is limited to 24 VDC maximum, the appropriate pre-configured cartridge can be selected. This allows the pulsed-output constant voltage LED driver to be reconfigured for different loads by inserting a different removeable cartridge.

Figure 9:
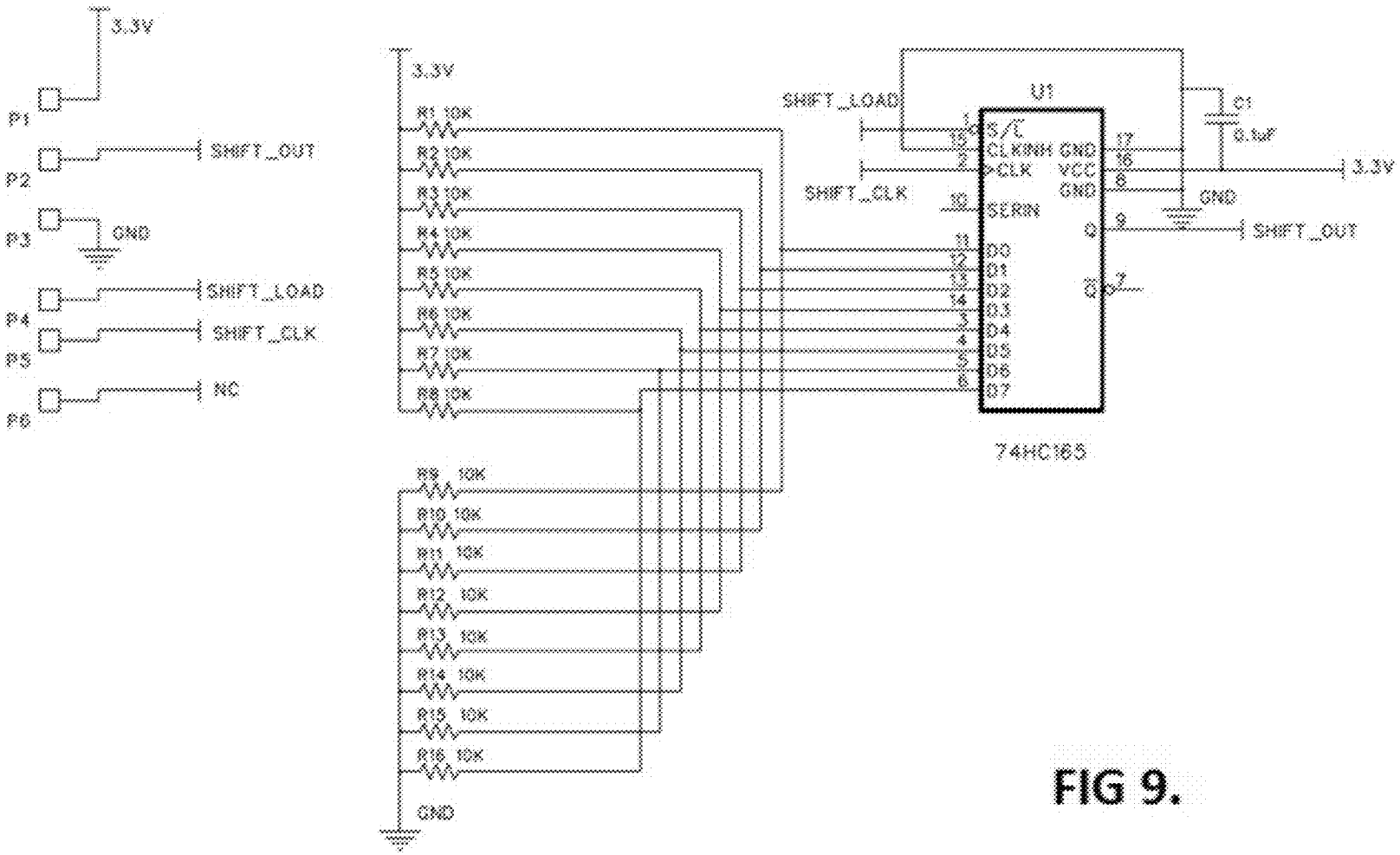
FIG. 9 is a schematic diagram of an example of a digital removeable cartridge.
Figure 10:
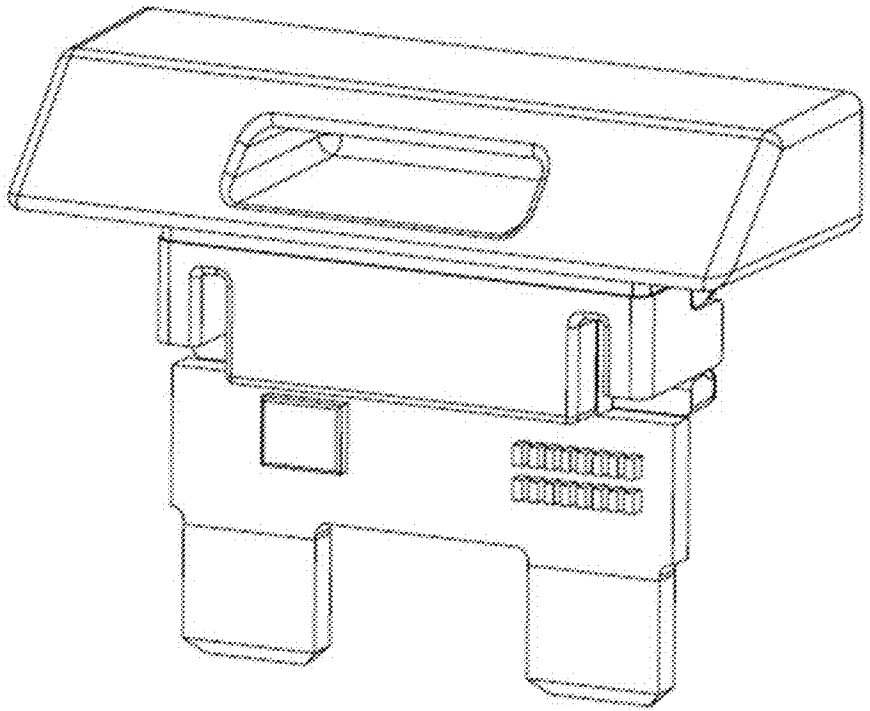
FIG. 10 is an illustration of a removeable cartridge.

The removeable cartridge embodiment is further described in FIG. 9 and FIG. 10. In FIG. 9 a shift register device is used to clock 8 bits of information out to the microcontroller in the pulsed-output constant voltage LED driver. The exact data value is set by the population of resistors R1-R16. As a result, a total of 256 different programming configurations are available. These configurations can be used to set the output pulse voltage amplitude as well as set other previously referenced pulsed-output constant voltage LED driver parameters. Additional data lines can be used to further increase the amount of configuration options.

Another aspect of this removeable cartridge is that a bit can be set that allows the cartridge to be used for special manufacturing purposes such as initiating auto test and calibration sequences.

The removeable cartridge can include features that allow for easy insertion and removal into the pulsed-output constant voltage LED driver. Another aspect of the embodiment is that for remote applications, marginally higher output voltages can be configured, such that losses due to remote mounting of the LED driver can be overcome. For example, assuming the LED system load requires V2A=24 VDC. If it is determined that line loss will result in a voltage drop of 2 volts, then the removeable cartridge can be configured such that the LED power supply produces a peak pulse amplitude of V2B=26 VDC.

Another aspect of the invention is that both the frame duration and the total number of pulse positions per frame can be defined in a removeable cartridge. Further, pulse partnering characteristics can be programmed via the removeable cartridge.

Figure 11:
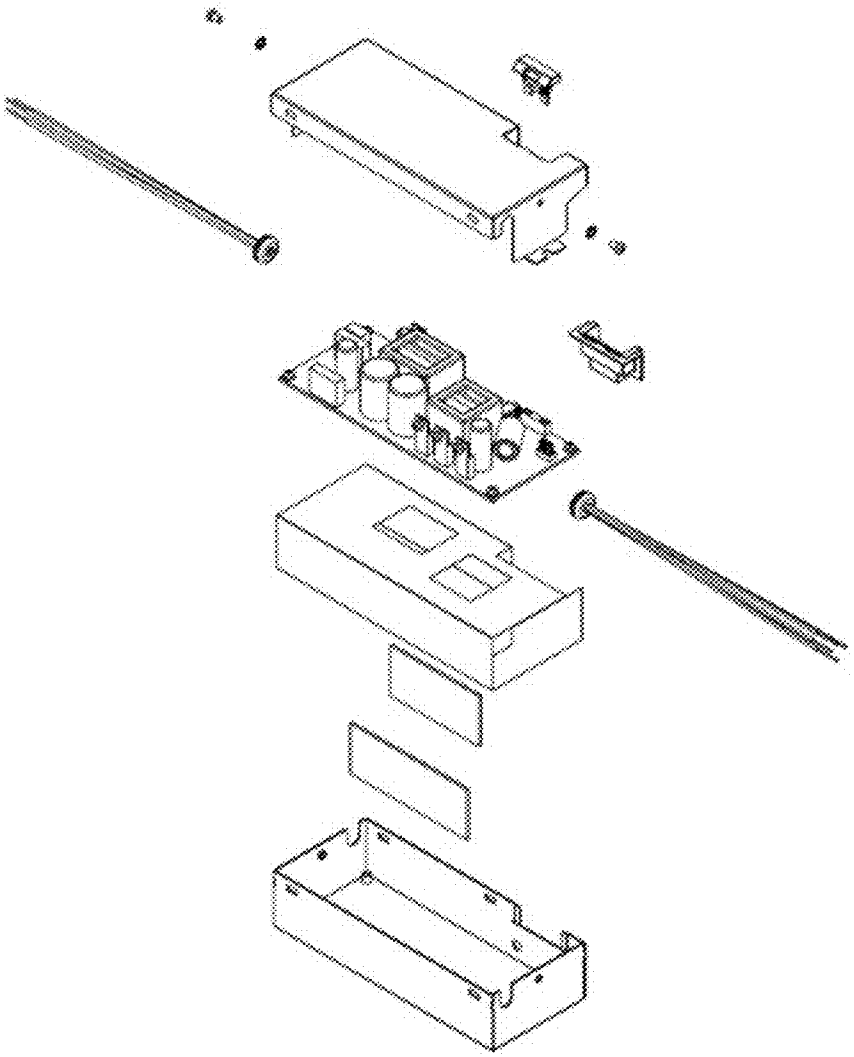
FIG. 11 is an illustration of a pulsed-output constant voltage LED driver with a removeable cartridge.

FIG. 11 illustrates the pulsed-output constant voltage LED driver with the removeable configuration cartridge.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Example embodiments of this invention are described herein, including the best mode known to the inventors for carrying out the invention. Variations of those example embodiments will be apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pulsed-output constant voltage LED driver comprising a pulse density modulation (PDM) stage configured to provide power to an LED load by supplying energy at either a first or second predetermined voltage during each of a plurality of segments of a predetermined time period, wherein the number of segments during which the first voltage is supplied is correlated with the power provided to the LED, and wherein the positions within the time period of the segments during which the first voltage is applied are random.

2. The pulsed-output constant voltage LED driver of claim 1, further comprising an interface module, the interface module supporting one or more input signals corresponding to a desired power to the LED load, and wherein the number of segments during which the first voltage is supplied is correlated with the desired power to the LED load.

3. The pulsed-output constant voltage LED driver of claim 2, wherein the one or more input signals comprises at least one of a 0-10 V analog input, a PWM input, a capacitive touch input, a phase cut input, a potentiometer input, and a command from a wired or wireless communications port.

4. The pulsed-output constant voltage LED driver of claim 2, wherein the one or more input signals allow a user to set a dimming level of the LED load.

5. The pulsed-output constant voltage LED driver of claim 1, wherein one or more low-level communication interfaces, discrete signals, or a combination thereof, allow one or more higher level control systems to interact with the LED driver either directly or via intermediate communication modules based on wired or wireless communications systems.

6. The pulsed-output constant voltage LED driver of claim 1, further comprising a plurality of PDM stages where each PDM stage is connected to a corresponding LED Load.

7. The pulsed-output constant voltage LED driver of claim 6, wherein the plurality of PDM stages is configured to achieve either white color tuning by varying a CCT level of the LED load, RGB color tuning by mixing light from red, green and blue LEDs, or independent control of the PDM channels.

8. The pulsed-output constant voltage LED driver of claim 1, wherein the positions are selected with a preference for adjacent positions.

9. The pulsed-output constant voltage LED driver of claim 1, further comprising a removeable plug-in cartridge that adjusts the first voltage to a value within a predetermined range of voltages.

10. The pulsed-output constant voltage LED driver of claim 1, further comprising a removeable plug-in cartridge that establishes constraints for the positions.

11. The pulsed-output constant voltage LED driver of claim 10, wherein the constraints comprise a minimum number of adjacent positions.

12. The pulsed output constant voltage LED driver of claim 1, further comprising a removeable plug-in cartridge that establishes characteristics of a luminaire when the luminaire is connected to the driver.

13. A method of supplying power to an LED load using a pulsed-output constant voltage LED driver, the method comprising: varying a number of pulses provided by the pulsed-output constant voltage LED driver over a fixed period of time such that the number of pulses determines the power level provided to the LED load, wherein varying the number of pulses allows for modulation in a light output of the LED load, and wherein the temporal position of the pulses in the fixed period of time is random.

14. The method of claim 13, further comprising providing an interface control configured to provide one or more input signals.

15. The method of claim 14, wherein providing an interface control configured to provide one or more input signals comprises providing an interface control configured to provide one of a 0-10V analog input, a PWM input, a capacitive touch input, a phase cut input, a potentiometer input, and a command from a wired or wireless communications port.

16. The method of claim 13, further comprising providing one or more low-level communication interfaces or discrete signals that allow a plurality of higher level control systems to interact with the pulsed-output constant voltage LED Driver either directly or via intermediate communication modules based on wired or wireless systems.

17. The method of claim 13, further comprising varying a CCT level of the LED load to achieve white color tuning.

18. The method of claim 13, further comprising mixing light from red, green and blue LEDs to achieve RGB color tuning.

19. The method claim 13, wherein temporal positions of the pulses are selected with a preference for adjacent positions.

20. A method of supplying power to an LED load using a pulsed-output constant voltage LED driver, the method comprising: varying a number of pulses provided by the pulsed-output constant voltage LED driver over a first fixed period of time such that the number of pulses determines the power level provided to the LED load, wherein varying the number of pulses allows for modulation in a light output of the LED load, and varying a number of pulses provided by the pulsed-output constant voltage LED driver over a second fixed period of time, immediately after the first fixed period of time, such that the number of pulses determines the power level provided to the LED load, and wherein the temporal position of the pulses in the first fixed period of time is different from the temporal positions of the pulses in the second fixed period of time.

* * * * *